US008764359B2

(12) United States Patent
Ma

(10) Patent No.: US 8,764,359 B2
(45) Date of Patent: Jul. 1, 2014

(54) BUILT-IN MOVABLE PALLET FOR CONTAINER

(76) Inventor: Jijun Ma, Wuxi (CN)

( * ) Notice: Subject to any disclaimer, the term of this patent is extended or adjusted under 35 U.S.C. 154(b) by 0 days.

(21) Appl. No.: 13/698,996

(22) PCT Filed: Jul. 20, 2011

(86) PCT No.: PCT/CN2011/077352
§ 371 (c)(1),
(2), (4) Date: Nov. 19, 2012

(87) PCT Pub. No.: WO2012/010086
PCT Pub. Date: Jan. 26, 2012

(65) Prior Publication Data

US 2013/0139735 A1 Jun. 6, 2013

(30) Foreign Application Priority Data

Jul. 22, 2010 (CN) ..... 2010 1 0236327

(51) Int. Cl.

| | |
|---|---|
| ***B60P 7/08*** | (2006.01) |
| ***B65D 19/42*** | (2006.01) |
| ***B65D 90/00*** | (2006.01) |
| ***B65D 90/18*** | (2006.01) |
| ***B65D 88/12*** | (2006.01) |

(52) U.S. Cl.
CPC ..... *B65D 19/42* (2013.01); *B65D 90/006* (2013.01); *B65D 90/18* (2013.01); *B65D 88/129* (2013.01)
USPC ..... 410/66; 410/46; 410/84

(58) Field of Classification Search
USPC ..... 410/46, 66, 67, 84, 89; 244/137.1; 108/55.1, 57.15; 414/498; 220/1.5
See application file for complete search history.

(56) References Cited

U.S. PATENT DOCUMENTS 3,744,837 A * 7/1973 Foster
7,517,180 B2 4/2009 Baker
8,491,240 B2 * 7/2013 Baker ..... 410/66
2007/0017421 A1 1/2007 Kumpel
2012/0039684 A1 2/2012 Baker

FOREIGN PATENT DOCUMENTS

AU 2009 903639 A1 8/2009
CN 100457579 C 2/2009

(Continued)

OTHER PUBLICATIONS

International Search Report Oct. 13, 2011.

*Primary Examiner* — Stephen Gordon
(74) *Attorney, Agent, or Firm* — Michael D. Eisenberg; Jeanette Meng Nakagawa

(57) ABSTRACT

The present invention relates to a kind of built-in movable pallet for containers, including the rectangular chassis with several rollers at the bottom. Several guiding mechanisms are set at both sides and the corners of front edge of the above-mentioned chassis; guiding mechanisms are guide roller structures; outer peripheral surface of guiding rollers protrudes to side edge of the chassis; locking mechanisms are installed at the two corners at rear edge of the chassis. In this invention, guide rollers are installed at two sides and the corners of front edge, so that the sliding friction with high resistance is converted into rolling friction with low resistance. While loading, outer peripheral surface of the guide rollers at corners of front edge contacts the firm doorframe of the container firstly, so relative parallel position of the pallet and the container is adjusted properly and basically; while further pushing, the relative position between the pallet and the container may be adjusted adaptively by guide rollers at sides, so as to prevent wall of the container from being crashed and even cut and protect the container effectively; the locking hook at corners of rear edge is reasonable structure, convenient for use and can be locked reliably.

11 Claims, 3 Drawing Sheets

(56) References Cited

FOREIGN PATENT DOCUMENTS

| | | | |
|---|---|---|---|
| CN | 201784968 | U | 4/2011 |
| CN | 101891046 | B | 9/2011 |
| WO | WO/2007041176 | A1 | 4/2007 |
| WO | WO2011014917 | A1 | 2/2011 |

* cited by examiner

BUILT-IN MOVABLE PALLET FOR CONTAINER

TECHNICAL FIELD

The present invention relates to the field of container transporting facilities, particularly a kind of built-in moveable pallet to be used in containers.

TECHNICAL BACKGROUND

In order to transport ocean freight containers filled with bulky and heavy goods, the goods should be conveyed or hoisted into containers and then fixed. Patent "U.S. Pat. No. 4,976,365 - - - Pallet and container integrated with pallet" discloses a kind of movable pallet with rollers at the bottom. In this patent, goods or small containers may be conveyed to and fixed on the pallet firstly; then, the pallet will be pushed into the ocean freight container; finally, the pallet can be fixed in the container. However, in actual use, locking structure of the patent is poor in reliability. While loading, each container is 20' and even 40' length, so the forklift has to be used for pushing at a long distance. While pushing, it's very hard to ensure that the pallet will be pushed stably in parallel along inner wall of the container, and the front corner of the pallet are liable to collide with wall of the container. Although a rubber pad is added to each front corner of the pallet and side wheels are set at both sides, while actual loading, the friction between rubber pad and side wall of the container is high, so it's hard to push. Transport environment is severe; the rubber pad is liable to be worn and fractured; steel structure of the pallet is hard; loading goods are very heavy; side wall of the container is generally made of thin corrugated steel plate (2 mm thick only), so edges and corners of the pallet are liable to crash and cut into side wall of the container and damage it. Besides, the principal axis of side wheels as referred to in the patent and the structure of the rolling bearing are weak and can't be impacted.

Patent "200380103526.2 - - - Mobile Pallet with Various Locking Means" discloses a kind of pallet for use with an ocean freight container, comprising: a chassis having a leading edge, a trailing edge opposite the leading edge and two opposite sides between the leading edge and the trailing edge; locomotion means for rolling chassis into, and out of, a freight container; a locking device is provided at two sides of, and located at, either the leading edge or the trailing edge of the pallet for immobilizing the chassis within the freight container with the locking device able to be engaged with a container wall, or another, adjacent pallet, to one side of the plurality of sides of the initial pallet for use with the freight container. The locking device if further able to engage a container wall, or the adjacent pallet, to the leading edge or the trailing edge of the initial pallet for preventing movement in mutually perpendicular directions in a horizontal plane. In this patent, various kinds of locking devices are set at leading corner, trailing corner and trailing center of the mobile pallet, so as to restrict the right and left clearance within the container by pivot structure of the leading corner and cylindrical spiral structure of the trailing corner and the leading and trailing clearance within the container by ratchet regulation structure of the trailing center. However, in actual use, these locking devices are complicated in structure and poor in reliability; the pivot structure of the leading corner is liable to be blocked and can't rotate flexibly; the spiral cylindrical structure of the trailing corner is cantilever beam structure and bears high shear force, so it often bends and breaks. If the spiral cylindrical structure bends, it can't rotate, leads to can't retreat from the slot; the pallet can't move; the goods can't be unloading; the spiral cylindrical structure must be cut off by force, so as to continue to work; however, if the spiral cylindrical structure is cut off, it will be unable to open the container; the whole pallet and goods may move freely and roll out of containers and result in an accident. The ratchet regulation structure of the trailing center has many components and is liable to be damaged, and the ratchet regulation structure can't be adjusted seamlessly due to its working principle. In conclusion, the above defects badly restrict wide application of the mobile pallet.

DESCRIPTION OF THE INVENTION

The applicant intends to provide a kind of built-in movable pallet for containers which is reasonable in structure, convenient and safe for loading, easy and reliable for locking operation, so as to overcome the above mentioned defects, such as hard loading of the movable pallet, easy damage of the container, and complicated structure, poor reliability and tedious operation of locking mechanisms etc.

This invention adopts the following technical solutions:

A kind of built-in movable pallet for containers, including the rectangular chassis with several rollers at the bottom; several guiding mechanisms are set at both sides and the corners of front edge of the above-mentioned chassis; guiding mechanisms are guide roller structures; outer peripheral surface of guiding rollers protrudes to side edge of the chassis. Besides, it is further characterized in:

The guide rollers at the corners of front edge are no more than 20 cm away from the front edge;

Each guide roller is formed by principal axis and outer ring through clearance fit; the clearance is filled with lubricating grease;

An oiling channel is set in the middle of the principal axis for each guide roller; inlet of the oiling channel connects with a grease fitting There is an oiling channel at outer ring of each guide roller which passes through the whole wall; inlet of the oiling channel connects with an end cap;

Locking mechanisms are set at two corners at rear edge of the chassis;

The locking mechanism is hook structure. Relative runway-shaped regulation holes are set at upper and lower surfaces of the frame of the hook; the hook is pivot jointed in the regulation holes by the centre shaft; the connecting rod passes through the through-hole in the middle of the centre shaft; one end of the connecting rod contacts the centre shaft through step surface; a spring housing is set on the connecting rod and is placed between the centre shaft and the middle clapboard of the frame; a handle is mounted at end of the connecting rod through threaded connection;

The hook is composed of two parallel upper and lower curved arms; thickness of the hook is smaller than width of the open slot of the hook frame;

In this invention, guide rollers are installed at sides and the corners of front edge, so that the sliding friction with high resistance is converted into rolling friction with low resistance. While loading, outer peripheral surface of the guide rollers at corners of the front edge contact the firm doorframe of the container firstly, so relative parallel position of the pallet and the container is adjusted properly and basically; while further pushing, the relative position between the pallet and the container will be adjusted adaptively by the guide rollers at sides, so as to prevent the container wall from being crashed and even cut and protect the container effectively. This invention adopts the guide roller structure that high rigid metal principal axis meshes with clearance of the metal outer ring; it is high strength, flexible rolling and can bear high impact load.

The curved arm hook referred to in the invention is not a cantilever beam structure. The locking mechanisms for both corners of rear edge are like two wide-open inclined struts and transfer locking limit force of front and back to the frame and the chassis. It is characterized in high structure strength and high reliability. The hook may be adjusted partially back and forth, up and down flexibly, and it can also be adjusted in right and left directions by rotating, so it is easy to adjust and is suitable for various types of containers. Only through tightening the handle, it can be tightened firmly; it is characterized in easy operation and reliable locking.

DETAILED DESCRIPTION OF THE PREFERRED EMBODIMENT

This invention will be further described with the attached figures.

Figure 1:
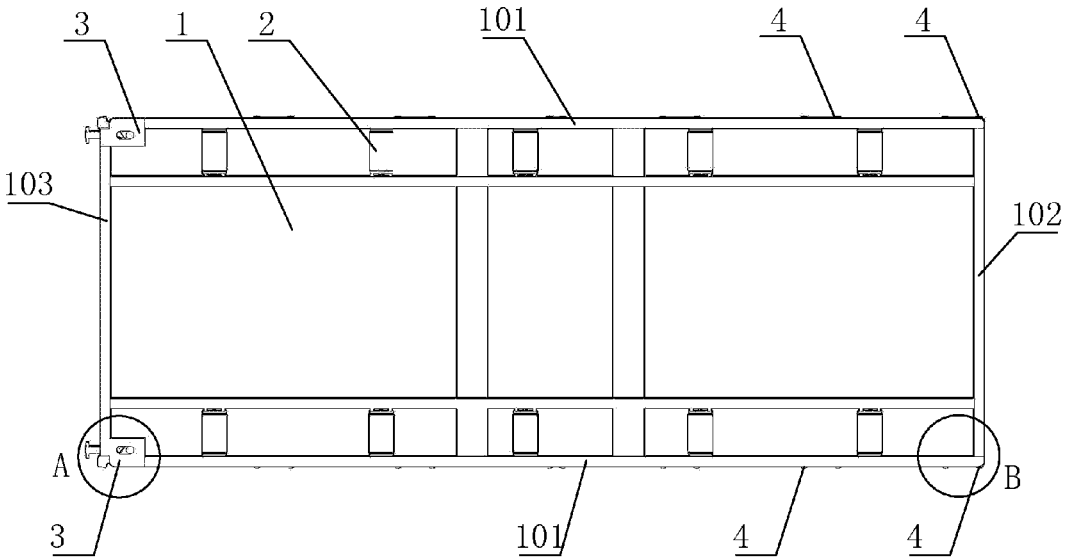
FIG. 1 is the front view of the invention.

As shown in FIG. 1, this invention includes chassis (1) with several rollers (2). In actual loading, the first end being pushed into the container is defined as front edge (102); the end at the door of rear side of the container is defined as rear edge (103). Front edge (102) and rear edge (103) are connected by both sides (101) formed rectangular structure of chassis (1). Several guiding mechanisms (4) are set at both sides (101) and corners of front edge of chassis (1). Outer peripheral surface of guiding mechanisms (4) protrudes to side edge of chassis (1); locking mechanisms (3) are set at both sides (101) of chassis (1) and corners of rear edge (103).

Figure 3:
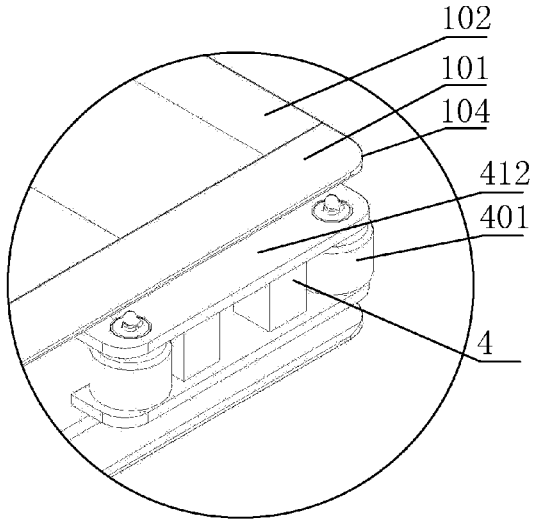
FIG. 3 is the enlarged space diagram of part B as shown in FIG. 1.

As shown in FIG. 3, guide mechanisms (4) of the invention are guide roller (401) structures. Guide rollers (401) are installed in the slot of "[" profile at side (101) and may be arranged separately or in groups. For the convenience of maintenance, disassembly and assembly, they are connected fixed in open slot of the side profile by upper and lower clamping plate (412). Outer peripheral surface of guide rollers (401) protrudes to opening edge of side profile. Herein, outer peripheral surface of the first guide roller (401) close to front edge (102) is no more than 20 cm away from front edge (102); this arrangement can prevent wall of the container from being impacted or cut by closed angle of the profile of front edge effectively. If entering angle of the pallet inclines, outer peripheral surface of guide rollers (401) will contact doorframe of the container firstly; regulate entering angle of the pallet through friction, so as to regulate adaptively the relative position between the pallet and the container. Generally, a doorframe is set at rear opening of the container. The doorframe is made of high strength U-bar profile and is high strength and rigidity. Further, corners of the profile may be filleted (104) or chamfered, so that outer peripheral surface of guide rollers (401) will protrude to front edge and the plane of one side and the regulation effect will be better.

Figure 4:
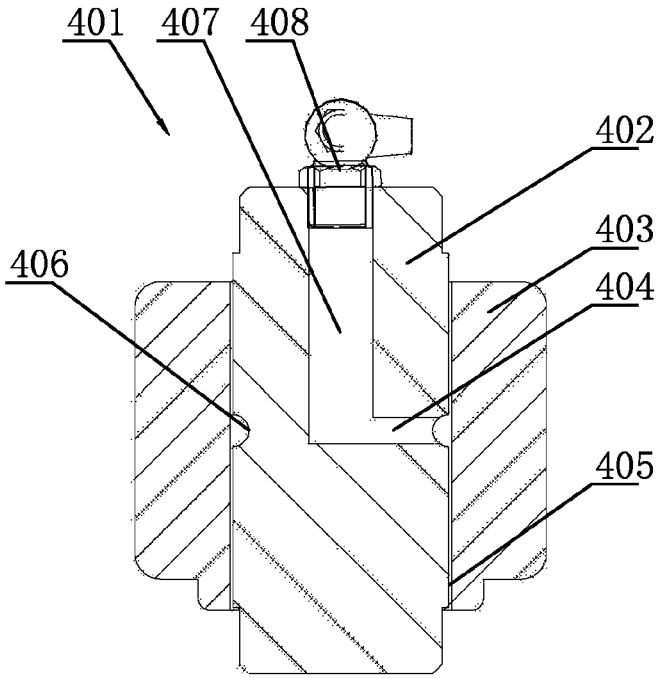
FIG. 4 is the sectional view of a kind of guide roller.
Figure 5:
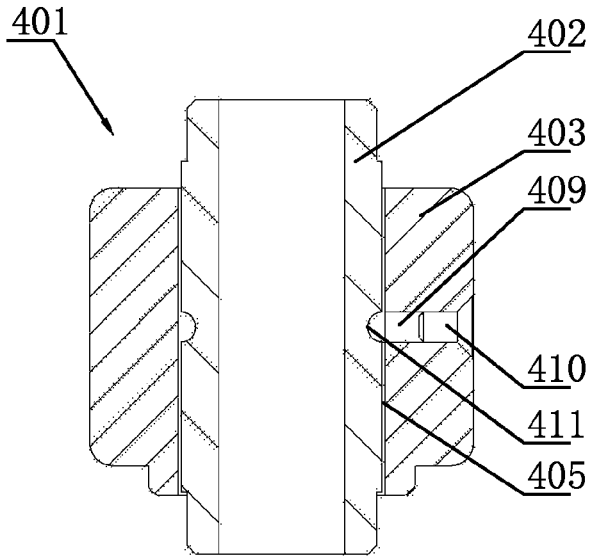
FIG. 5 is the sectional view of another kind of guide roller.

As shown in FIG. 4 and FIG. 5, guide roller (401) is formed by fixing principal axis (402) and outer ring (403) through clearance fit; butter and other lubricating grease are applied to clearance (405) for filling and lubricating. FIG. 4 is the guide roller oiling from top; blind pore (407) is set in the middle of principal axis (402); end of blind pore (407) connects with grease fitting (408) by threaded connection; bottom of blind pore (407) connects with annular oil storage tank (406) in the middle of outer peripheral surface of principal axis (402) through connecting hole (404). While filling, lubricating grease is filled through grease fitting (408), blind pore (407), connecting hole (404) and oil storage tank (406) in turn and is distributed to the clearance (405) between principal axis (402) and outer ring (403). This kind of structure is high in manufacturing cost, and solid principal axis is heavy. FIG. 5 is the guide roller oiling from side; principal axis (402) may be made of pipe; annular oil storage tank (411) may be set in the middle of outer peripheral surface; accordingly; oiling through oil hole (409) is made on wall of outer ring (403); its external side is matched with an end cap (410) of countersunk. Before filling lubricating grease, unscrew the end cap (410), fill grease directly through oil hole (409), oil storage tank (411) and distribute it to the clearance (405) between principal axis (402) and outer ring (403), after filling, tighten end cap (410) and seal it. This kind of structure is simple in manufacturing, convenient for use, and reduce weight of guide roller (401).

Figure 6:
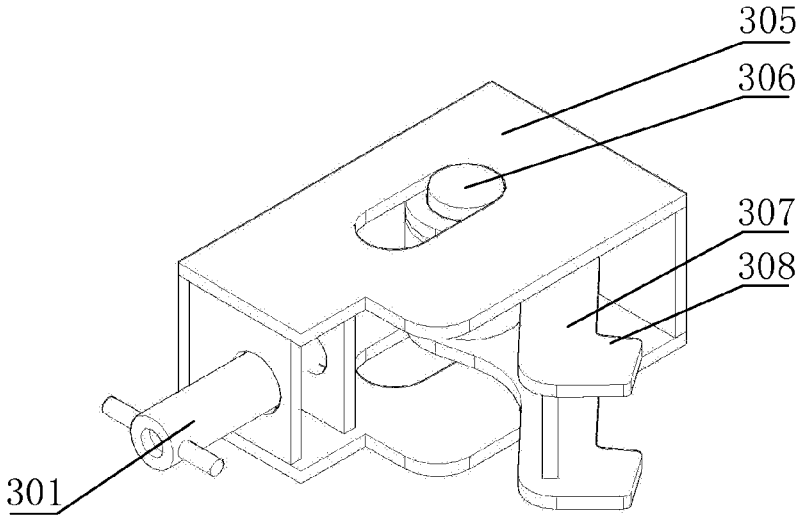
FIG. 6 is the space diagram of the locking hook at opening and locking state.
Figure 7:
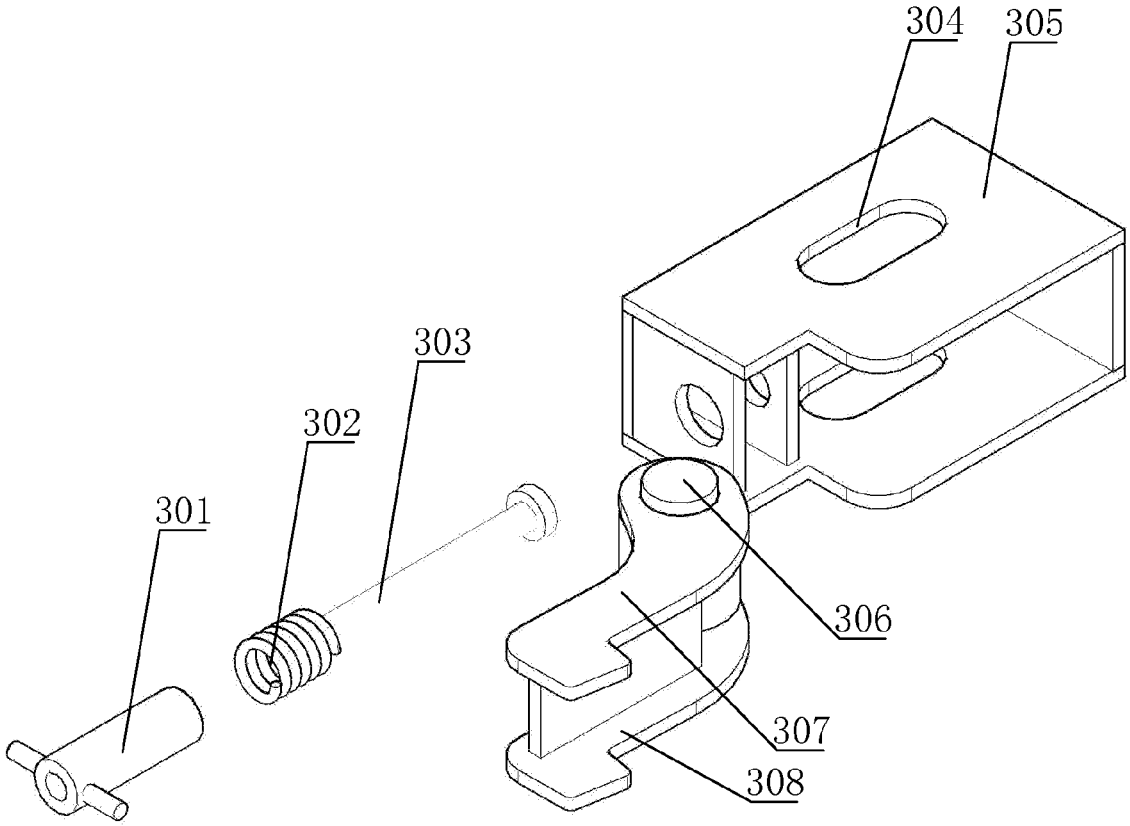
FIG. 7 is the explosion space diagram of the locking hook.

This invention adopts the guide roller structure that high rigid metal principal axis meshes with clearance of the metal outer ring; it is high in strength, flexible in rolling and can bear high impact load. Certainly, outer ring may also be sleeved by some cushion material, such as rubber, but it is liable to crack. While loading, outer peripheral surface of guide roller (401) contacts the doorframe of the container firstly, so as to convert the sliding friction with high resistance into rolling friction with low resistance and reduce the difficulty of pushing largely. While further pushing, relative position between the pallet and the container will be regulated adaptively, so as to prevent the container wall from being crashed and even cut and protect the container effectively In this invention, locking mechanisms (3) are set at both sides (101) of chassis (1) and corners of its rear edge (103). As shown in FIG. 6 and FIG. 7, locking mechanisms (3) are side hook structures which connect the two corners installed at rear edge of chassis (1) through frame (305). Relative runway-shaped regulation holes are set at upper and lower surfaces of frame (305); arc curved arm hook (307) is pivot jointed in the regulation holes by centre shaft (306); hook (307) may rotate along centre shaft (306); centre shaft (306) may move back and forth within relative runway-shaped regulation holes (304). Hook (307) is composed of two parallel upper and lower curved arms (308) which are supported by a support plate; thickness of hook (307) is smaller than width of the open slot of frame (305), so it can move up and down along centre shaft (306). Through-hole is set in centre shaft (306), and connecting rod (303) passes through the through-hole; one end of the connecting rod contacts centre shaft (306) through step surface; spring (302) housing is set on connecting rod (303) and is placed between centre shaft (306) and the middle clapboard of frame (305). A handle is mounted at end of the connecting rod through threaded connection; while rotating handle (301), connecting rod (303) may be pulled back and forth or released, so as to enable centre shaft (306) to move back and forth in runway-shaped regulation holes (304).

Figure 2:
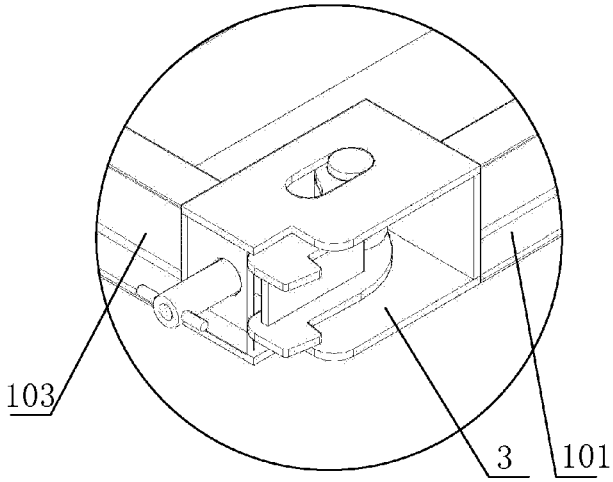
FIG. 2 is the enlarged space diagram of part A as shown in FIG. 1.

In actual loading, the pallet is pushed into the container, right now locking mechanisms (3) are approximately at doorframe of opening place of the container. As shown in FIG. 1 and FIG. 2, locking mechanisms (3) are at contraction position; their hook (307) doesn't exceed side width of chassis (1). Then, operator rotates and turns out hook (307). As shown in FIG. 6, front edge of hook is inserted into opening of U-bar profile of the doorframe and contact two sides of U-bar profile. Centre shaft (306) may move back and forth and rotate in runway-shaped regulation holes (304), so back and froth, right and left distances may be regulated flexibly according to various different positions of chassis (1) and doorframe structure of the container, thus hook (307) can be placed in opening of U-bar profile of doorframe correctly. Hook (307) may also move up and down within a small range, so it can keep away from the commonly used transverse connecting-bar in the doorframe and prevent interference. Finally, rotate and tighten handle (301), tighten connecting rod (303); compact centre shaft (306) by spring (302) so as to prevent it from moving back and forth in runway-shaped regulation hole (304). At the moment, every degree of freedom is restricted by hook (307), restricted it firmly. While unloading, release handle (301) reversely and take back hook (307), and the whole pallet can be taken out from the container. To sum up, it is very convenient for operation.

The above descriptions are explanation but not restriction to this invention. As to the restricted scope of the invention, please refer to the Claims. On the premise of not disobeying idea of the invention, the invention may be revised in any manner.

What is claimed is:

1. A movable pallet for loading and securing goods into a container, the pallet comprising:

a rectangular chassis defined by a front edge positioned to enter the container first, a rear edge in parallel to the front edge, and opposing side edges connecting the front and rear edges;

at least one set of wheels under the chassis along the opposing side edges of the pallet for mobility;

at least one guiding mechanism installed in a slot along a side of the chassis at a corner defined by the front edge and one of the side edges; wherein the guiding mechanism further comprises:

at least one principle axis fixed inside of the slot;

a roller fitted around the principle axis, wherein an outer surface of the roller protrudes from the side of the chassis, and an inner surface of the roller is set with a predetermined amount of clearance from the principle axis to allow room for lubricating materials that facilitates rotational movement; and at least one locking mechanism comprising a frame installed along the side of the chassis at a corner defined by the rear edge and the side edge; wherein the locking mechanism further comprises:

a hook structure with a footed end extending outward and rearward from the frame along the side of the chassis to latch onto a preset slot on a wall of the container;

a rotating handle to adjust an angle of extension of the hook structure by simultaneously guiding and pivoting the hook structure along two opposing preset paths on the frame of the locking mechanism.

2. The movable pallet of claim 1, wherein the guiding mechanism is installed so that the outer surface of the roller is no more than 20 cm away from the front edge.

3. The movable pallet of claim 1, wherein the guiding mechanism comprises multiple principle axes and rollers assembled in parallel to one another.

4. The movable pallet of claim 1, wherein the guiding mechanism comprises an annular storage tank embedded in the clearance between the roller and the principle axis with an opening for injecting lubricating material into the clearance, and an end cap for sealing the opening.

5. The movable pallet of claim 1, wherein the principle axis of the guiding mechanism further comprises:

a tubular body with a hollow central cavity to store lubricating material, and connected to an annular storage tank embedded in the clearance between the roller and the principle axis; and at least one end cap to seal the hollow central cavity.

6. The movable pallet of claim 1, wherein the outer surface of the roller of the guiding mechanism can be fitted with impact absorbing sleeves.

7. The movable pallet of claim 1, wherein the hook structure of the locking mechanism comprises a pair of hooks connected by a center shaft, and mirror one another, wherein each hook further comprises a pivoting end and a footed end extending outward and rearward.

8. The movable pallet of claim 7, wherein both pivoting ends of the hooks of the hook structure are allowed to move only within the preset paths on the frame of the locking mechanism.

9. The movable pallet of claim 1, wherein the handle of the locking mechanism is connected to a connecting rod via a threaded connection, and the connecting rod in turn passes through a spring housing and an opening in a center shaft of the hook structure, and pushes against an opposing end of the frame.

10. The movable pallet of claim 9, wherein a rotation of the handle compresses and releases the spring housing, which in turn pushes and pulls a center shaft along the preset paths on the frame and simultaneously rotates the center shaft around pivoting ends of hooks of the hook structure.

11. The movable pallet of claim 9, wherein a rotation of the handle is in a locked position when the footed end of the hook structure is latched onto the preset slot on the wall of the container.

* * * * *